US010244841B2

(12) United States Patent
Hayashi

(10) Patent No.: US 10,244,841 B2
(45) Date of Patent: Apr. 2, 2019

(54) STRUCTURE OF HAND-CARRYING PORTION OF BAG AND METHOD FOR ATTACHING THE SAME

(71) Applicant: HAYASHIGO CO., LTD., Osaka (JP)

(72) Inventor: Kaoru Hayashi, Osaka (JP)

(73) Assignee: HAYASHIGO CO., LTD., Osaka (JP)

( * ) Notice: Subject to any disclaimer, the term of this patent is extended or adjusted under 35 U.S.C. 154(b) by 202 days.

(21) Appl. No.: 14/782,789

(22) PCT Filed: Jul. 9, 2014

(86) PCT No.: PCT/JP2014/068348
§ 371 (c)(1),
(2) Date: Oct. 6, 2015

(87) PCT Pub. No.: WO2015/005396
PCT Pub. Date: Jan. 15, 2015

(65) Prior Publication Data

US 2016/0029764 A1 Feb. 4, 2016

(30) Foreign Application Priority Data

Jul. 11, 2013 (JP) ..... 2013-145667

(51) Int. Cl.
*A45C 13/26* (2006.01)
*A45C 3/06* (2006.01)

(52) U.S. Cl.
CPC ..... *A45C 13/26* (2013.01); *A45C 3/06* (2013.01)

(58) Field of Classification Search
CPC ..... A45C 13/26; A45C 3/06
See application file for complete search history.

(56) References Cited

U.S. PATENT DOCUMENTS 526,566 A * 9/1894 Field ..... B65D 33/12 2/248
1,677,583 A * 7/1928 Cromwell, Jr. ..... B65D 29/00 383/119
D249,392 S * 9/1978 Pelavin ..... D3/303
(Continued)

FOREIGN PATENT DOCUMENTS

JP H11-103925 A 4/1999
JP 4430734 B1 3/2010
JP 3180402 U 12/2012

*Primary Examiner* — Tri Mai
(74) *Attorney, Agent, or Firm* — Rabin & Berdo, P.C.

(57) ABSTRACT

A structure of a hand-carrying portion provides a method for excellent durability to use a bag for years. According to the present invention, a hand-carrying portion (14) attached to a bag main body (12) includes an outer side hand-carrying member (50) and an inner side hand-carrying member (70) overlapped to an inner side of the outer side hand-carrying member in a hand-carrying region (A1); ends of the inner side hand-carrying member are attached to an outer surface of the bag main body; and the outer side hand-carrying member has one and another ends attached to an outer side of the bag main body with an appropriate interval between attachment portions (72, 74), which the inner side hand-carrying member attached to the bag main body, in an extended region extended in a bottom direction of the bag main body from a region overlapped with the inner side hand-carrying member.

7 Claims, 15 Drawing Sheets

(56) References Cited

U.S. PATENT DOCUMENTS

| | | | | | |
|---|---|---|---|---|---|
| 4,799,521 | A * | 1/1989 | Shick | A45C 13/26 | 150/107 |
| 5,127,536 | A * | 7/1992 | Cohen | A45C 3/04 | 150/102 |
| D331,532 | S * | 12/1992 | Cohen | 383/16 | |
| 5,431,317 | A * | 7/1995 | Kliot | A45F 3/02 | 224/153 |
| 5,518,315 | A * | 5/1996 | Nichols | A45C 13/36 | 383/119 |
| 5,639,004 | A * | 6/1997 | Carlton | A45C 9/00 | 190/125 |
| 5,695,286 | A * | 12/1997 | Williamson | B65D 88/1612 | 383/16 |
| 6,155,206 | A * | 12/2000 | Godshaw | A01K 1/0254 | 119/453 |
| 7,028,873 | B1 * | 4/2006 | Collier | A45F 3/08 | 224/628 |
| D535,820 | S * | 1/2007 | Kamiya | D3/246 | |
| 7,950,509 | B2 * | 5/2011 | Redzisz | A45C 3/00 | 190/111 |
| 2013/0188892 | A1 * | 7/2013 | Bevier | A45C 3/001 | 383/104 |
| 2015/0201722 | A1 * | 7/2015 | Brouard | A45C 3/001 | 150/107 |

* cited by examiner

CROSS-SECTIONAL VIEW TAKEN ALONG LINE a-a

CROSS-SECTIONAL VIEW TAKEN ALONG LINE b-b

CROSS-SECTIONAL VIEW TAKEN ALONG LINE c-c

A1 : HAND-CARRYING REGION
A2 : NON-SEWING REGION
A3 : JOINING REGION
A4 : NON-JOINING REGION

STRUCTURE OF HAND-CARRYING PORTION OF BAG AND METHOD FOR ATTACHING THE SAME

TECHNICAL FIELD

The present invention relates to a structure of a hand-carrying portion of a bag such as a handbag, a shoulder bag, and the like, and a method for attaching the same.

BACKGROUND ART

A handle attachment structure disclosed in Japanese Patent No. 4430734 (patent document 1), for example, is proposed for the hand-carrying portion of the handbag, the shoulder bag, and the like.

According to the handle attachment structure of patent document 1, the handle is formed by joining an outer handle section and an inner handle section, a distal end portion of the outer handle section being attached to a surface of a body and a distal end portion of the inner handle section being attached while being sandwiched between the body and an upper gore section, and handle excels in durability so that the bag can be used over many years.

CITED PRIOR ART DOCUMENT

Patent Document

[Patent document 1] Japanese Patent No. 4430734

DISCLOSURE OF THE INVENTION

[Problems to be Solved by the Invention]

However, since the handle is attached to the upper part of the body in the handle attachment structure of patent document 1, the body and the upper gore portion are drawn closer each time the bag is lifted up, and the body may stretch. Furthermore, the vicinity of the attachment portion of the handle may rub against each other through use over many years, and the sewing thread may break.

Thus, it is an object of the present invention to provide a structure of a hand-carrying portion that excels in durability and that allows the bag to be used over many years, and a method for attaching the same.

[Means for Solving the Problem]

A structure of a hand-carrying portion of a bag according to an aspect of the present invention relates to a structure of a hand-carrying portion attached to a bag main body; wherein the hand-carrying portion includes an outer side hand-carrying member, and an inner side hand-carrying member partially overlapped with an inner side of the outer side hand-carrying member in a hand-carrying region; the inner side hand-carrying member has one end and another end attached to an outer surface of the bag main body; and the outer side hand-carrying member has one end and another end attached to an outer side of the bag main body with an appropriate interval between attachment portions to the bag main body of the inner side hand-carrying member in an extended region extended in a bottom direction of the bag main body from the region overlapped with the inner side hand-carrying member.

The structure of the hand-carrying portion of the bag according to a further aspect of the present invention relates to the structure of the hand-carrying portion of the bag, wherein the outer side hand-carrying member and the inner side hand-carrying member are sewn in a hand-carrying region where the outer side hand-carrying member and the inner side hand-carrying member are joined with an equal interval between the one end of the inner side hand-carrying member and the one end of the outer side hand-carrying member and with an equal interval between the other end of the inner side hand-carrying member and the other end of the outer side hand-carrying member to form a non-joining region that is not to be sewn to the inner side hand-carrying member in an extended region of the outer side hand-carrying member extended from the sewn region.

The structure of the hand-carrying portion of the bag according to another aspect of the present invention relates to the structure of the hand-carrying portion of the bag, wherein the extended region of the outer side hand-carrying member has a sandwiching portion for sandwiching an article between the inner side of the outer side hand-carrying member and the outer surface of the bag main body.

The structure of the hand-carrying portion of the bag according to another aspect of the invention relates to the structure of the hand-carrying portion of the bag according to the present invention, wherein the inner side hand-carrying member is a long band-shaped body, and the outer side hand-carrying member is a long band-shaped body having a wider width than the inner side hand-carrying member; and the inner side hand-carrying member is joined with the outer surface covered by the outer side hand-carrying member in the hand-carrying region.

The structure of the hand-carrying portion of the bag according to another aspect of the invention relates to the structure of the hand-carrying portion of the bag according to the present invention, wherein the bag main body has a bottom member attached to an outer side; and the extended region of the outer side hand-carrying member is inserted between the bottom member and the bag main body from an edge portion of a joining region to the bag main body of the bottom member, and attached to the outer surface of the bag main body and/or the inner surface of the bottom member.

The structure of the hand-carrying portion of the bag according to another aspect of the invention relates to the structure of the hand-carrying portion of the bag according to the present invention, wherein the bag main body has a pocket attached to an outer side; and the extended region of the outer side hand-carrying member is inserted into the pocket from an article inserting opening of the pocket, and attached to the outer surface of the bag main body.

A method for attaching a hand-carrying portion of the bag according to another aspect of the invention relates to a method for attaching a hand-carrying portion of the bag, the method including the steps of joining an inner side hand-carrying member and an outer side hand-carrying member with an equal interval between one end of the inner side hand-carrying member and one end of the outer side hand-carrying member and with an equal interval between another end of the inner side hand-carrying member and another end of the outer side hand-carrying member, and adhering a joining region of the inner side hand-carrying member and the outer side hand-carrying member with an adhesive; sewing a vicinity of a longitudinal end edge of the outer side hand-carrying member and a vicinity of a longitudinal end edge of the inner side hand-carrying member in a region where the outer side hand-carrying member and the inner side hand-carrying member are joined; attaching the one end of the inner side hand-carrying member and the other end of the inner side hand-carrying member to an outer surface of the bag main body; attaching the one end and the other end of the outer side hand-carrying member on an outer side of the bag main body with an appropriate interval between attachment portions to the bag main body of the inner side hand-carrying member in an extended region extended in a bottom direction of the bag main body from a region where the outer side hand-carrying member is joined to the inner side hand-carrying member.

The method for attaching the hand-carrying portion of the bag according to another aspect of the invention relates to the method for attaching the hand-carrying portion of the bag according to the present invention, further including a step of curving a vicinity of a middle in a width direction in a region where the outer side hand-carrying member and the inner side hand-carrying member are joined.

Effects of the Invention

According to the structure of the hand-carrying portion of the bag in the present invention, the load on the attachment portion of the hand-carrying portion can be dispersed when the bag is lifted, and hence the bag main body is less likely to lose shape, and a bag that excels in durability and that can be used for many years can be provided.

According to the invention, the outer side hand-carrying member and the inner side hand-carrying member are sewn in the hand-carrying region where the outer side hand-carrying member and the inner side hand-carrying member are joined with an equal interval between one end of the inner side hand-carrying member and one end of the outer side hand-carrying member and with an equal interval between the other end of the inner side hand-carrying member and the other end of the outer side hand-carrying member to form the non-joining region that is not to be sewn to the inner side hand-carrying member in an extended region of the outer side hand-carrying member extended from the sewn region, whereby the article can be sandwiched by the non-joining region.

According to the invention, the extended region of the outer side hand-carrying member has a sandwiching portion for sandwiching an article between the inner side of the outer side hand-carrying member and the outer surface of the bag main body, whereby the article can be sandwiched by the sandwiching portion.

According to the invention, the inner side hand-carrying member is a long band-shaped body, and the outer side hand-carrying member is a long band-shaped body having a wider width than the inner side hand-carrying member; and the inner side hand-carrying member is joined with the outer surface covered by the outer side hand-carrying member in the hand-carrying region, whereby a strong hand-carrying portion can be formed.

According to the invention, the bag main body has a bottom member attached to an outer side; and the extended region of the outer side hand-carrying member is inserted between the bottom member and the bag main body from an edge portion of the joining region to the bag main body of the bottom member, and attached to the outer surface of the bag main body and/or the inner surface of the bottom member, whereby the a strong attachment of the hand-carrying portion to the bag main body can be obtained.

According to the invention, the bag main body has a pocket attached to an outer side; and the extended region of the outer side hand-carrying member is inserted into the pocket from an article inserting opening of the pocket, and attached to the outer surface of the bag main body, whereby the attachment of the hand-carrying portion to the bag main body can be protected with the pocket.

According to the method for attaching a hand-carrying portion of the bag of the present invention, the load on the attachment portion of the hand-carrying portion can be dispersed when the bag is lifted, and hence the bag main body is less likely to lose shape, and a bag that excels in durability and that can be used for many years can be provided.

The objects described above as well as other objects, characteristics, and advantages of the present invention should become apparent from the description on the modes for implementing the invention accompanied by the drawings.

BEST MODE FOR CARRYING OUT THE INVENTION

Hereinafter, a structure of a hand-carrying portion of a bag according to the present invention will be described based on one embodiment.

Figure 1:
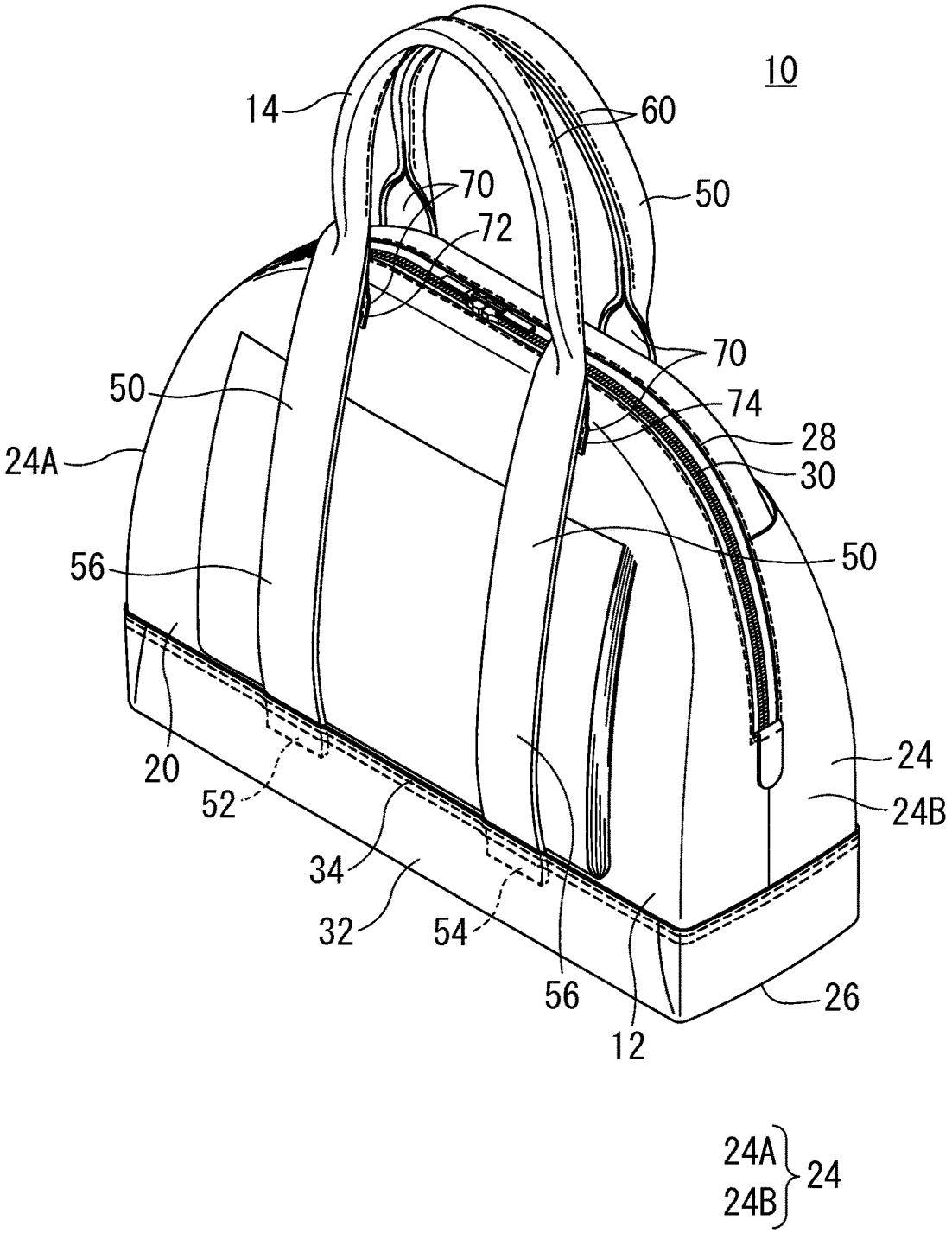
FIG. 1 is a perspective view of a bag using a structure of a hand-carrying portion of a bag according to one embodiment of the present invention.
Figure 2:
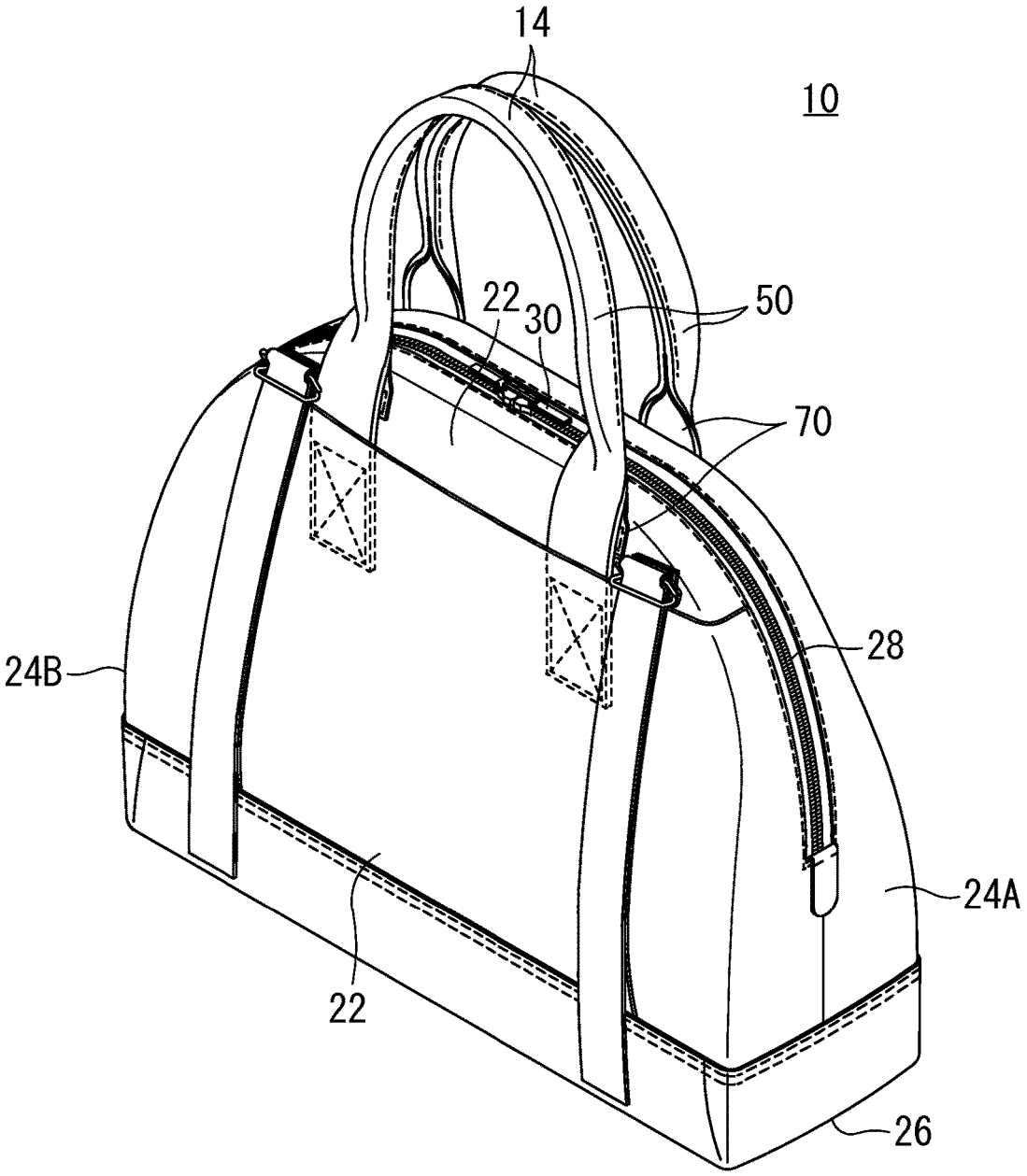
FIG. 2 is a perspective view of a rear side of the bag of FIG. 1.
Figure 3:
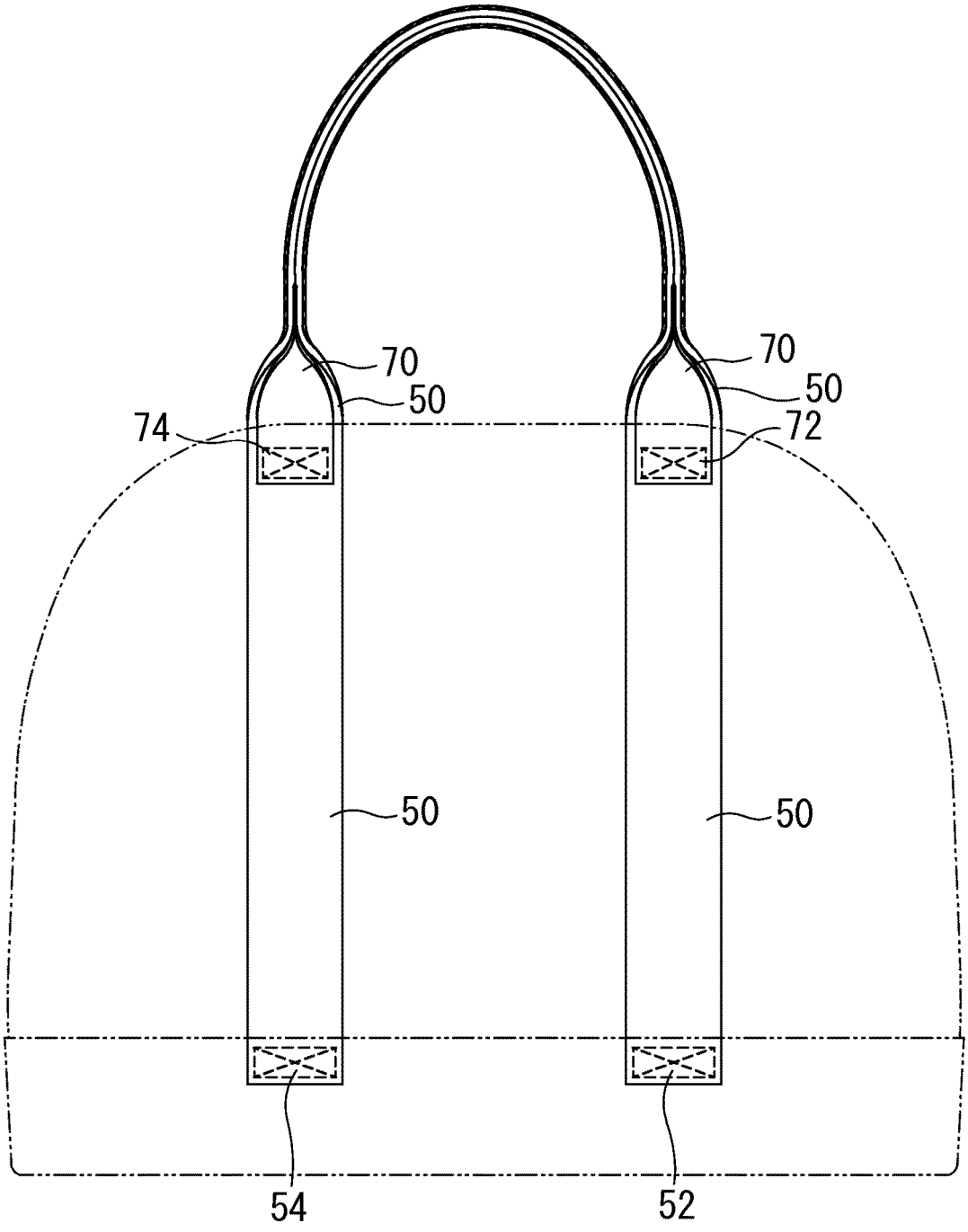
FIG. 3 is a rear view showing the structure of a hand-carrying portion of the bag of FIG. 1.
Figure 4:
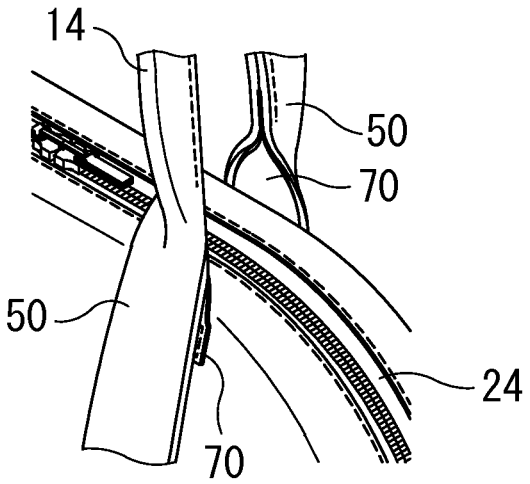
FIG. 4 is a perspective view showing the structure of the hand-carrying portion of the bag of FIG. 1.
Figure 5:
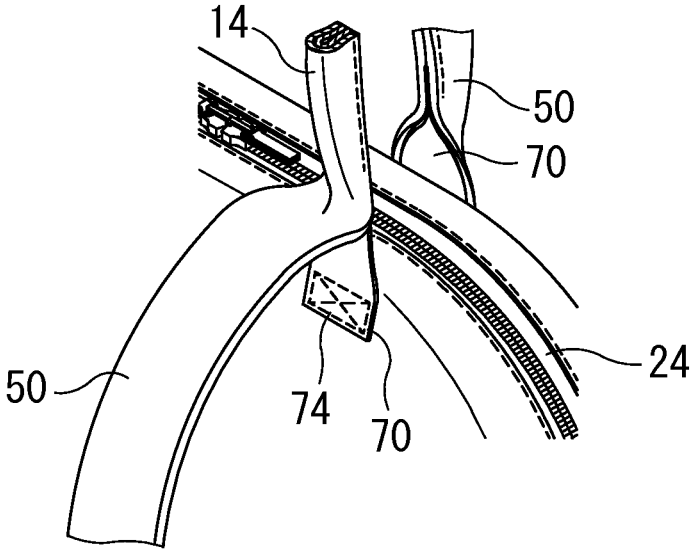
FIG. 5 is a perspective view showing the structure of the hand-carrying portion of the bag of FIG. 1.
Figure 6:
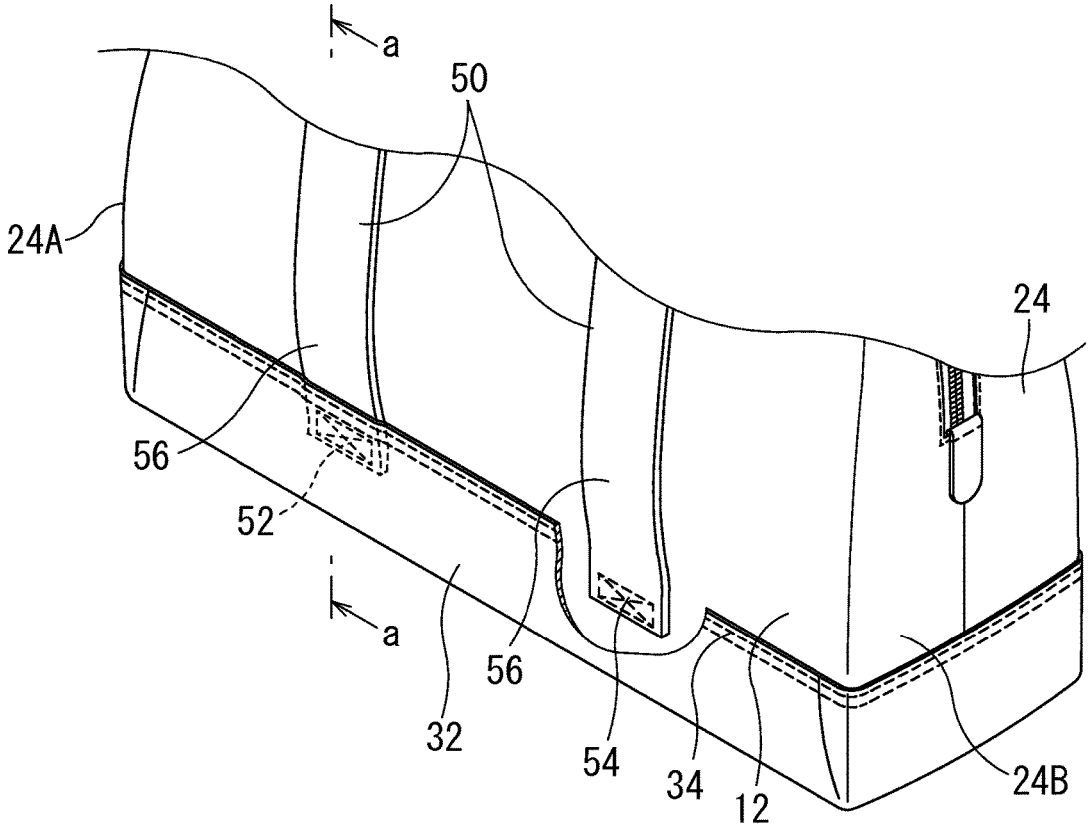
FIG. 6 is a perspective view showing the structure of the hand-carrying portion of the bag of FIG. 1.
Figure 7:
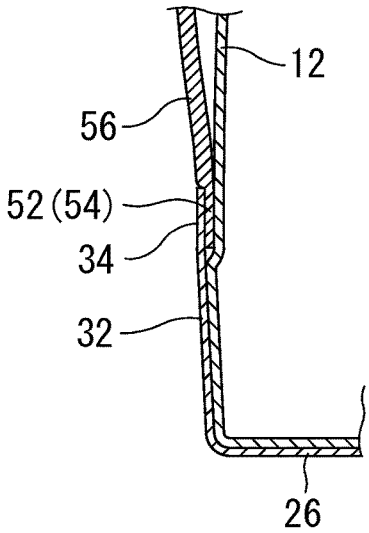
FIG. 7 is a cross-sectional view showing the structure of the hand-carrying portion of the bag of FIG. 1.
Figure 8:
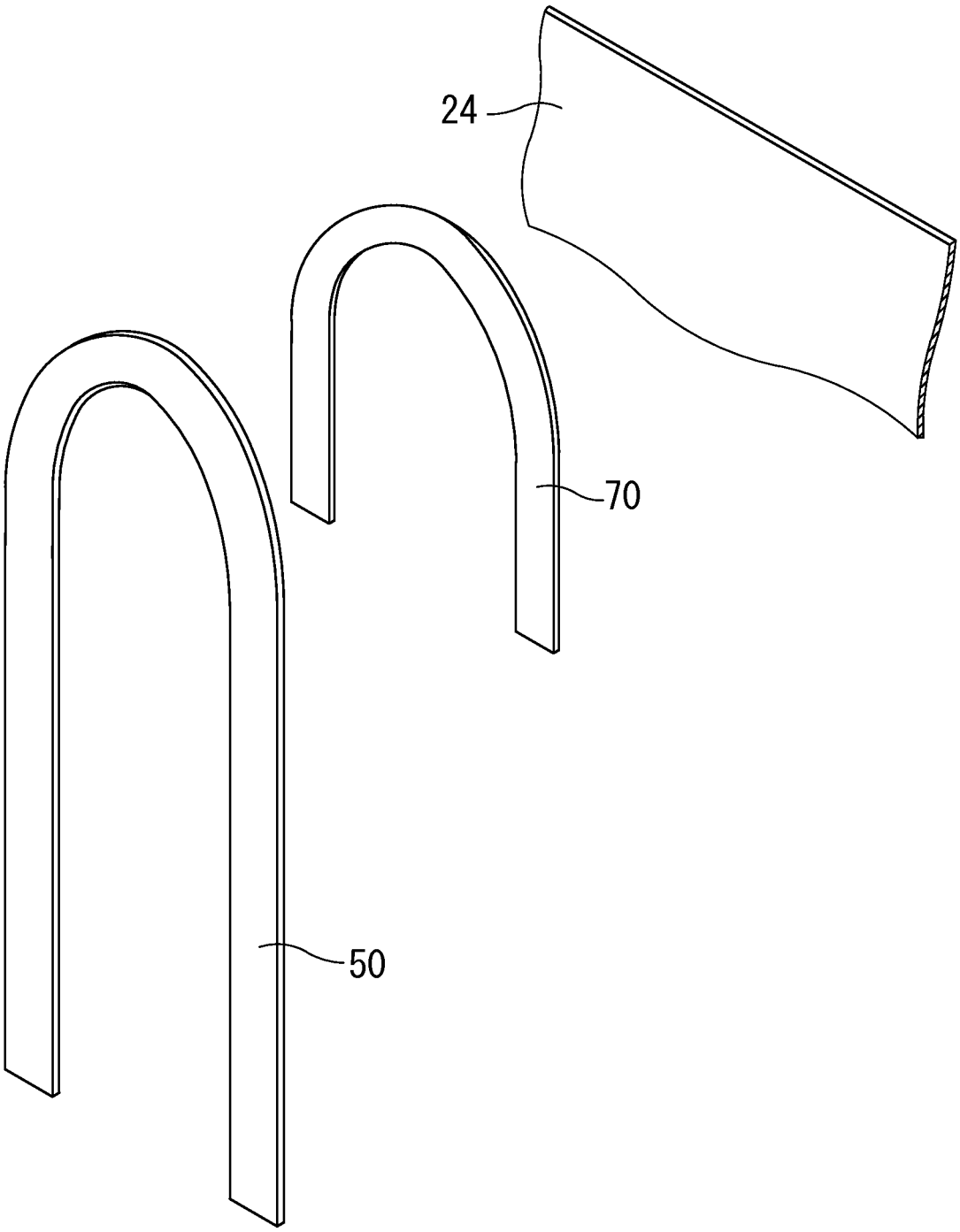
FIG. 8 is a perspective view showing a manufacturing process of the hand-carrying portion of the bag of FIG. 1.
Figure 9A:
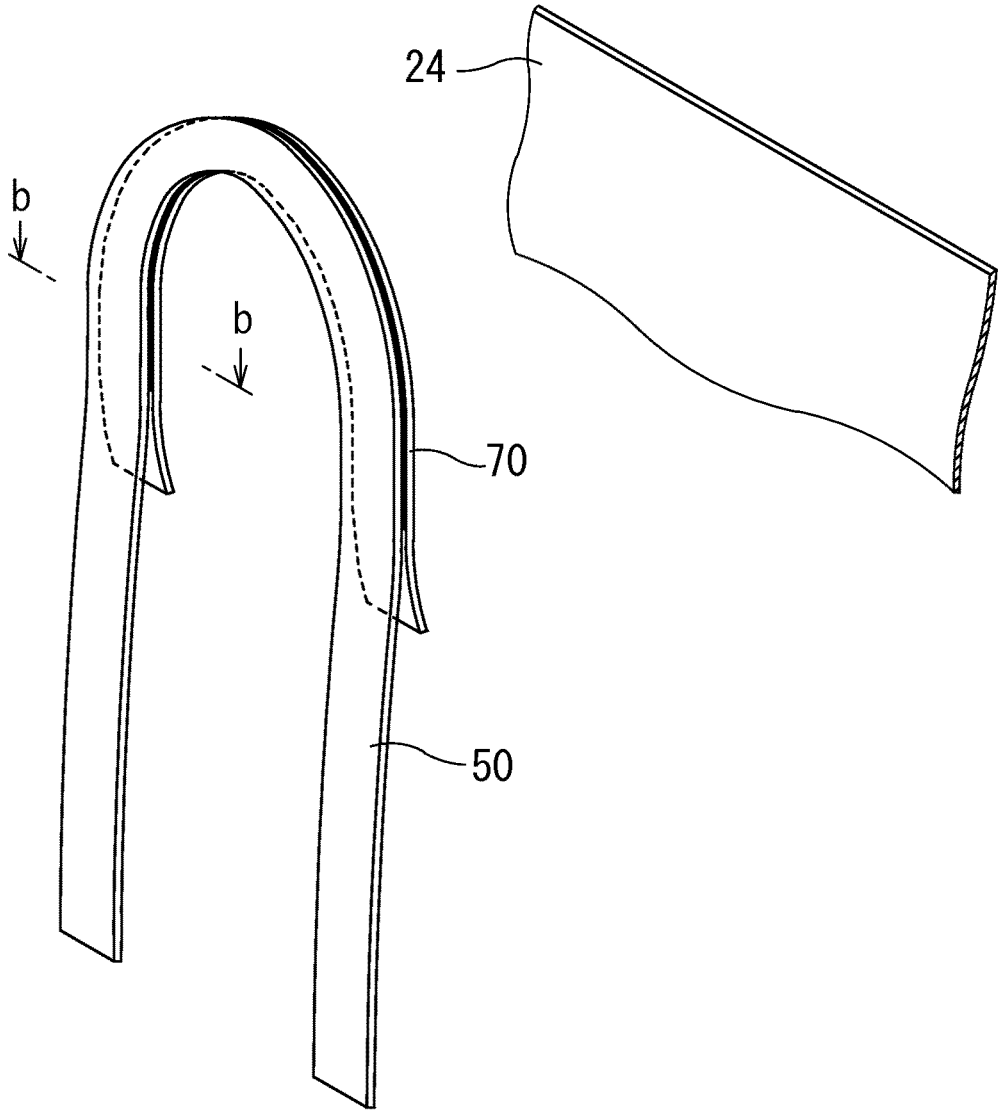
FIG. 9A is a perspective view showing the manufacturing process of the hand-carrying portion of the bag of FIG. 1.
Figure 9B:
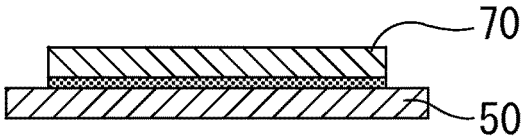
FIG. 9B is a cross-sectional view taken along line b-b in FIG. 9A.
Figure 10A:
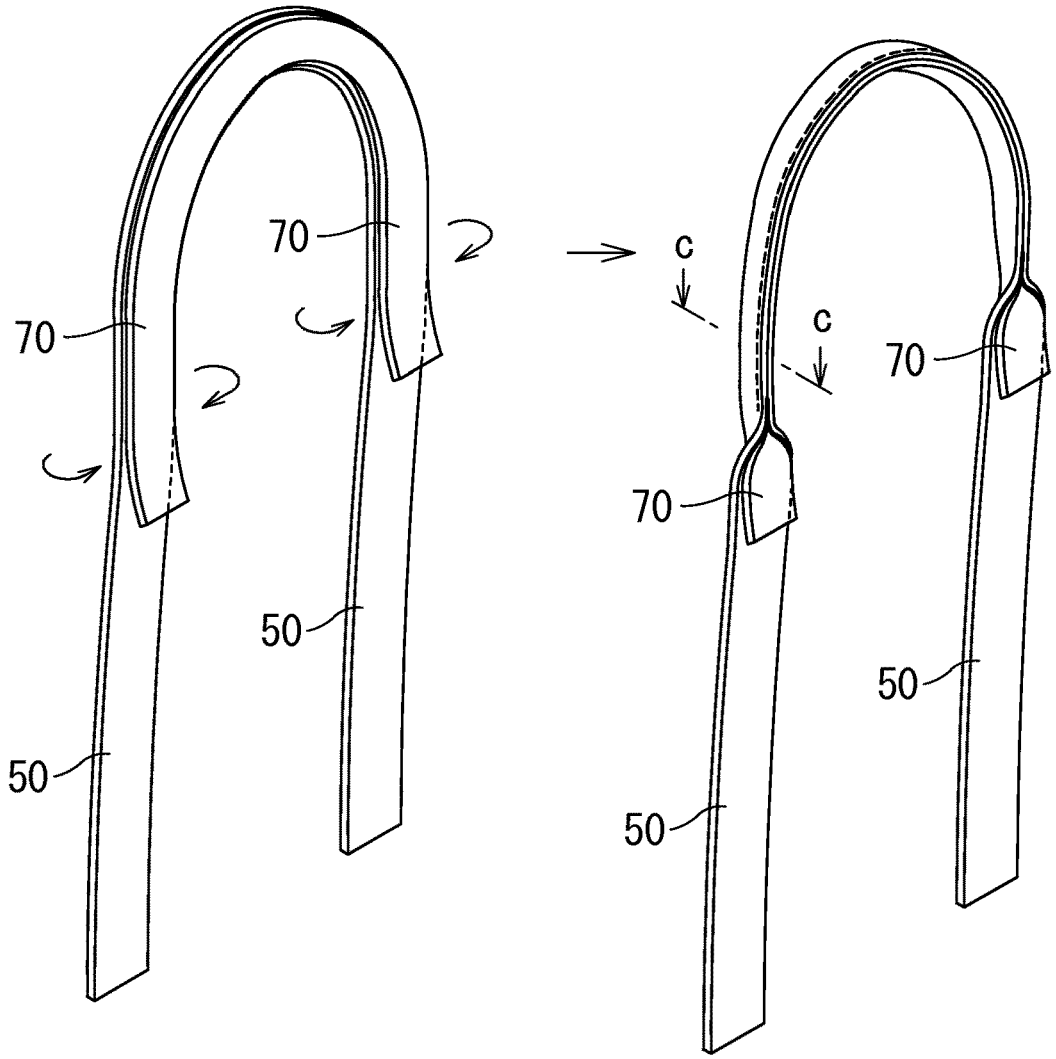
FIG. 10A is a perspective view showing the manufacturing process of the hand-carrying portion of the bag of FIG. 1.
Figure 10B:
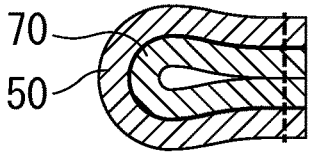
FIG. 10B is a cross-sectional view taken along line c-c in FIG. 10A.
Figure 11:
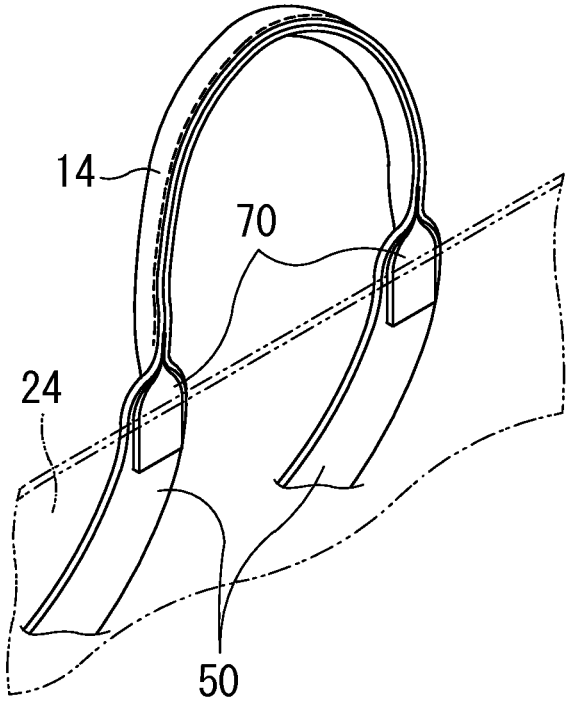
FIG. 11 is a perspective view showing the manufacturing process of the hand-carrying portion of the bag of FIG. 1.
Figure 12:
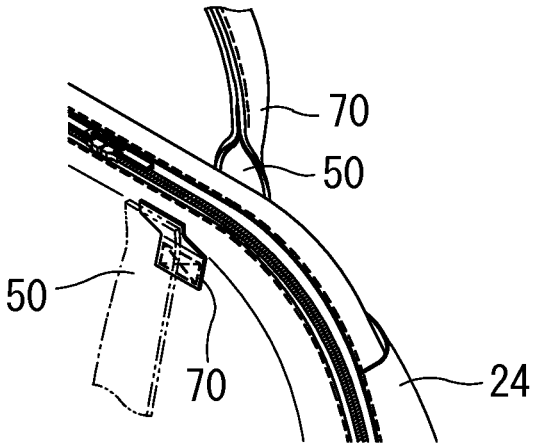
FIG. 12 is a perspective view showing the manufacturing process of the hand-carrying portion of the bag of FIG. 1.
Figure 13:
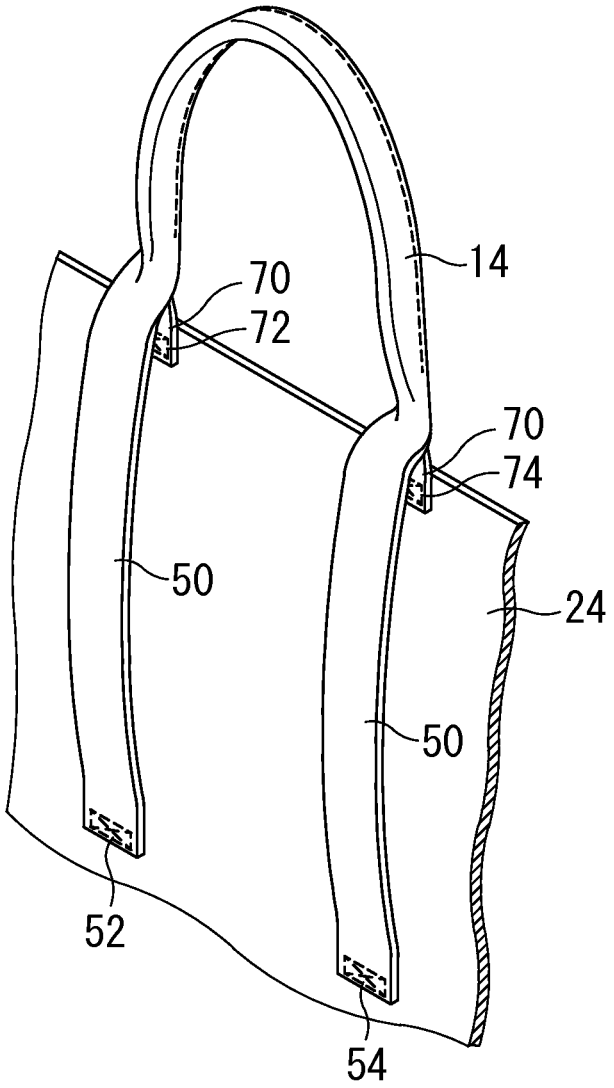
FIG. 13 is a perspective view showing the manufacturing process of the hand-carrying portion of the bag of FIG. 1.

FIG. 1 is a perspective view of a bag using a structure of a hand-carrying portion of a bag according to one embodiment of the present invention; FIG. 2 is a perspective view of a rear side of the bag of FIG. 1; FIG. 3 is a rear view showing the structure of a hand-carrying portion of the bag of FIG. 1; FIG. 4 is a perspective view showing the structure of the hand-carrying portion of the bag of FIG. 1; FIG. 5 is a perspective view showing the structure of the hand-carrying portion of the bag of FIG. 1; FIG. 6 is a perspective view showing the structure of the hand-carrying portion of the bag of FIG. 1; and FIG. 7 is a cross-sectional view showing the structure of the hand-carrying portion of the bag of FIG. 1.

As shown in FIG. 1, the structure of the hand-carrying portion of the bag of the present invention can be used to attach a hand-carrying portion 14 to a bag main body 12 of a hand-carrying bag 10 such as an overnight bag, and the like. The structure of the hand-carrying portion of the bag of the present invention can also be used in a shoulder bag, and the like, other than the hand-carrying bag.

The bag main body 12 includes a front body portion 20, a back body portion 22 facing the front body portion 20, a gore portion 24 interposed between the front body portion 20 and the back body portion 22, and a bottom portion 26 arranged at the lower ends of the front body portion 20, the back body portion 22, and the gore portion 24.

An opening 28 between the front body portion 20 and the back body portion 22 is configured to be opened and closed with a zipper 30 provided at the open edge of the front body portion 20 and an open edge of the back body portion 22.

The gore portion 24 includes a left side gore portion 24A formed on the left side of the front body portion 20, and a right side gore portion 24B formed on the right side of the front body portion 20.

The bottom portion 26 is formed by sewing a bottom member 32 overlapped with the outer surfaces of the front body portion 20, the back body portion 22, and the gore portion 24 at the lower end edges of the front body portion 20, the back body portion 22, and the gore portion 24.

The bottom member 32 is entirely formed to a plate shape, where the peripheral edge thereof is sewed to the front body portion 20, the back body portion 22, and the gore portion 24 at a bottom member joining region 34 having a constant width.

The structure of the hand-carrying portion attached to the bag main body 12 of the present invention is applied to the hand-carrying portion 14 in which a hand-carrying region A1, which is to be carried by the person's hand, is attached to extend toward the upper side of the front body portion 20 and/or the back body portion 22 on the outer side of the bag main body 12.

The hand-carrying portion 14 includes an outer side hand-carrying member 50, and an inner hand-carrying member 70 partially overlapped with the inner side of the outer side hand-carrying member 50 in the hand-carrying region A1.

The outer side hand-carrying member 50 and the inner side hand-carrying member 70 are curved to a substantially U-shape in front view in the hand-carrying region A1.

The inner side hand-carrying member 70 is a long band-shaped body, and the outer side hand-carrying member 50 is a long band-shaped body having a wider width than the inner side hand-carrying member 70.

The outer side hand-carrying member 50 and the inner side hand-carrying member 70 are made of leather or fabric.

The outer side hand-carrying member 50 and the inner side hand-carrying member 70 have different lengths, where the outer side hand-carrying member 50 is longer than the inner side hand-carrying member 70.

The inner side hand-carrying member 70 is joined with the outer surface covered by the outer side hand-carrying member 50 in the hand-carrying region A1.

The outer side hand-carrying member 50 and the inner side hand-carrying member 70 are overlapped with an even interval between one end of the inner side hand-carrying member 70 and one end of the outer side hand-carrying member 50 and an even interval between the other end of the inner side hand-carrying member 70 and the other end of the outer side hand-carrying member 50, and are sewn together to configure the hand-carrying region A1.

The outer side hand-carrying member 50 and the inner side hand-carrying member 70 are overlapped with an even interval between one end of the inner side hand-carrying member 70 and one end of the outer side hand-carrying member 50 and an even interval between the other end of the inner side hand-carrying member 70 and the other end of the outer side hand-carrying member 50, where a joining region of the inner side hand-carrying member 70 and the outer side hand-carrying member 50 is adhered with an adhesive.

The outer side hand-carrying member 50 and the inner side hand-carrying member 70 are curved at near the middle in the width direction in the overlapped region.

The outer side hand-carrying member 50 and the inner side hand-carrying member 70 have the vicinity of the longitudinal end edge of the outer side hand-carrying member 50 and the vicinity of the longitudinal end edge of the inner side hand-carrying member 70 sewn together to form a sewing portion 60 in the overlapped region.

The sewing portion 60 is formed up to the vicinity of one end and the vicinity of the other end of the inner side hand-carrying member 70 with a spacing between a region (attachment portion 72 and attachment portion 74, to be described later) where the inner side hand-carrying member 70 is attached to the surface of the bag main body 12 in the region extended from the hand-carrying region A1.

The inner side hand-carrying member 70 has one end and the other end attached to the outer surface of the bag main body 12.

In the present embodiment, the inner side hand-carrying member 70 has one end sewn to the vicinity of the left side gore portion 24A configuring the gore portion 24 in the vicinity of the opening 28 of the front body portion 20 to form the attachment portion 72, and the other end sewn to the vicinity of the right side gore portion 24B configuring the gore portion 24 in the vicinity of the opening 28 of the front body portion 20 to form the attachment portion 74.

The inner side hand-carrying member 70 has a region configuring the attachment portion 72 of one end and the attachment portion 74 of the other end sewn to the back surface side in a flat state of the long band-shaped body configuring the inner side hand-carrying member 70 brought into contact with the outer surface of the bag main body 12.

The inner side hand-carrying member 70 has a non-sewing region A2, which is not to be sewn to the outer side hand-carrying member 50, between a joining region A3 with respect to the outer side hand-carrying member 50 in the hand-carrying region A1, and the attachment portion 72 and the attachment portion 74.

The inner side hand-carrying member 70 has a non-joining region A4, which is not sewn to the outer side hand-carrying member 50, in a mode of a band-shaped body in a flat state of the long band-shaped body configuring the inner side hand-carrying member 70.

The outer side hand-carrying member 50 is joined to the outer side of the inner side hand-carrying member 70 in the hand-carrying region A1, and curved to a U-shape in front view with the inner side hand-carrying member 70.

The outer side hand-carrying member 50 and the inner side hand-carrying member 70 are curved to a U-shape in front view near the middle in the longitudinal direction of the long band-shaped body configuring the outer side hand-carrying member 50 and the long band-shaped body configuring the inner side hand-carrying member 70.

The outer side hand-carrying member 50 is attached on the outer side of the bag main body 12 with an appropriate interval between the attachment portion 72 of one end serving as an attachment portion to the bag main body 12 of the inner side hand-carrying member 70 and the attachment portion 74 of the other end serving as the attachment portion to the bag main body 12 in the extended region extended in the bottom direction of the bag main body 12 from the hand-carrying region A1 overlapped with the inner side hand-carrying member 70.

The outer side hand-carrying member 50 has a non-sewing region A2 that is not sewn to the inner side hand-carrying member 70 up to the position of joining with the attachment portion 72 and the attachment portion 74 of the inner side hand-carrying member 70 in the extended region extended from the joining region A3 where the outer side hand-carrying member 50 is joined to the inner side hand-carrying member 70 configuring the hand-carrying region A1.

The outer side hand-carrying member 50 has a part of the non-sewing region A2 (portion on one end side and other end side on lower side of sewing portion 60) that is not sewn to the inner side hand-carrying member 70 in a mode of a band-shaped body in a flat state of the long band-shaped body configuring the outer side hand-carrying member 50.

In the extended region (non-sewing region A2) of the outer side hand-carrying member 50 extended from the hand-carrying region A1 configured by the joining region A3 where the outer side hand-carrying member 50 and the inner side hand-carrying member 70 are sewn, the outer side hand-carrying member 50 has the non-joining region A4 where the outer side hand-carrying member 50 is not sewn to the inner side hand-carrying member 70 in the extended region from the joining region A3 of the attachment portion 72 and the attachment portion 74 of the inner side hand-carrying member 70.

The extended region of the outer side hand-carrying member 50 is inserted between the bottom member 32 and the bag main body 12 from the edge portion of the joining region to the bag main body 12 of the bottom member 32, and attached to the outer surface of the bag main body 12 and/or inner surface of the bottom member 32.

In the embodiment, the outer side hand-carrying member 50 has one end sewn across the front body portion 20 and the bottom member 32 between the outer side hand-carrying member 50 and the bottom member joining region 34 of the bottom member 32 and the front body portion 20 in the vicinity of the left side gore portion 24A.

Specifically, when sewing the bottom member 32 and the front body portion 20 in the bottom member joining region 34, the outer side hand-carrying member 50 is attached in an attachment portion 52, where one end of the outer side hand-carrying member 50 sandwiched between the front body portion 20 and the bottom member 32 is sewn.

Furthermore, the other end is sewn across the front body portion 20 and the bottom member 32 between the outer side hand-carrying member 50 and the bottom member joining region 34 of the bottom member 32 and the front body portion 20 in the vicinity of the right side gore portion 24B.

Specifically, when sewing the bottom member 32 and the front body portion 20 in the bottom member joining region 34, the outer side hand-carrying member 50 is attached in an attachment portion 54, where the other end of the outer side hand-carrying member 50 sandwiched between the front body portion 20 and the bottom member 32 is sewn.

The outer side hand-carrying member 50 has a region configuring the attachment portion 52 and the attachment portion 54 sewn to the back surface side in the flat state of the long band-shaped body configuring the outer side hand-carrying member 50 brought into contact with the outer surface of the bag main body 12.

The outer side hand-carrying member 50 has the non-joining region A4 that is not joined to the inner side hand-carrying member 70 in the extended region of the outer side hand-carrying member 50 extended from the sewn joining region A3.

The outer side hand-carrying member 50 has the non-joining region A4 that is not sewn to the inner side hand-carrying member 70 in a mode of the band-shaped body in the flat state of the long band-shaped body configuring the outer side hand-carrying member 50.

The non-joining region A4, which is the extended region of the outer side hand-carrying member 50, includes a sandwiching portion 56 for sandwiching an article in an empty place between the inner side thereof and the outer surface of the bag main body 12.

The method for attaching the hand-carrying portion of the bag will now be described based mainly on FIGS. 8 to 13.

The method for attaching the hand-carrying portion of the bag includes a hand-carrying member adhering step of joining the inner side hand-carrying member 70 and the outer side hand-carrying member 50 with an equal interval between the one end of the inner side hand-carrying member 70 and the one end of the outer side hand-carrying member 50 and with an equal interval between the other end of the inner side hand-carrying member 70 and the other end of the outer side hand-carrying member 50, and adhering the joining region of the inner side hand-carrying member 70 and the outer side hand-carrying member 50 with an adhesive; a curving step of curving the vicinity of the middle in the width direction in a region where the outer side hand-carrying member 50 and the inner side hand-carrying member 70 are joined; a sewing step of sewing the vicinity of the longitudinal end edge of the outer side hand-carrying member 50 and the vicinity of the longitudinal end edge of the inner side hand-carrying member 70 in a region where the outer side hand-carrying member 50 and the inner side hand-carrying member 70 are joined; an inner side hand-carrying member attaching step of attaching the one end of the inner side hand-carrying member 70 and the other end of the inner side hand-carrying member 70 to the outer surface of the bag main body 12; and an outer side hand-carrying member attaching step of attaching the attachment portion 52 at one end and the attachment portion 54 at the other end on the outer side of the bag main body 12 with an appropriate interval between the attachment portions (attachment portion 72 at one end and attachment portion 74 at other end) to the bag main body 12 of the inner side hand-carrying member 70 in the extended region extended in the bottom direction of the bag main body 12 from the region where the outer side hand-carrying member 50 is joined to the inner side hand-carrying member 70.

The extended region of the outer side hand-carrying member 50 has one end and the other end inserted between the bottom member 32 and the bag main body 12 from the edge portion of the bottom member joining region 34 to the bag main body 12 of the bottom member 32, and the one end and the other end attached to the outer surface of the bag main body 12 and/or the inner surface of the bottom member 32.

In the hand-carrying member adhering step, the front surface of the inner side hand-carrying member 70 and the back surface of the outer side hand-carrying member 50 are joined with an equal interval between the one end of the inner side hand-carrying member 70 and the one end of the outer side hand-carrying member 50 and with an equal interval between the other end of the inner side hand-carrying member 70 and the other end of the outer side hand-carrying member 50. The joining region of the inner side hand-carrying member 70 and the outer side hand-carrying member 50 is adhered with the adhesive applied in advance to the front surface of the inner side hand-carrying member 70 and the back surface of the outer side hand-carrying member 50.

In the curving step, the outer side hand-carrying member 50 and the inner side hand-carrying member 70 both have the vicinity of the middle in the width direction of a region configuring the hand-carrying region A1 curved to a substantially C-shape in the region where the outer side hand-carrying member 50 and the inner side hand-carrying member 70 are joined.

In the sewing step, the vicinity of the longitudinal end edge of the outer side hand-carrying member 50 and the vicinity of the longitudinal end edge of the inner side hand-carrying member 70 are sewn in the region where the outer side hand-carrying member 50 and the inner side hand-carrying member 70 are joined by the curving step.

The longitudinal end edge of the outer side hand-carrying member 50 and the longitudinal end edge of the inner side hand-carrying member 70 that are curved are aligned, the opposing back surfaces of the inner side hand-carrying member 70 are brought into contact, and the outer side hand-carrying member 50 and the inner side hand-carrying member 70 are sewn.

In the inner side hand-carrying member attaching step, one end of the inner side hand-carrying member 70 and the other end of the inner side hand-carrying member 70 are attached to the outer surface of the bag main body 12.

The one end and the other end of the inner side hand-carrying member 70 are attached to the bag main body 12 with an appropriate space suited for carrying by hand.

In the outer side hand-carrying member attaching step, the outer side hand-carrying member 50 has the attachment portion 52 at one end and the attachment portion 54 at the other end attached on the outer side of the bag main body 12 with an appropriate interval between the attachment portions (attachment portion 72 at one end and attachment portion 74 at other end) to the bag main body 12 of the inner side hand-carrying member 70 in the extended region extended in the bottom direction of the bag main body 12 from the region where the outer side hand-carrying member 50 is joined to the inner side hand-carrying member 70.

The extended region of the outer side hand-carrying member 50 has one end and the other end inserted between the bottom member 32 and the bag main body 12 from the end edge of the bottom member joining region 34 to the bag main body 12 of the bottom member 32, and the one end and the other end attached to the outer surface of the bag main body 12 and/or the inner surface of the bottom member 32.

In the outer side hand-carrying member 50, the portion extending to one side and the portion extending to the other wide, with the hand-carrying region A1 in between, sag toward the lower side than the attachment portion 72 and the attachment portion 74 of the inner side hand-carrying member 70.

The bag having a structure of the hand-carrying portion 14 of the bag according to the present invention is thereby formed.

Figure 14:
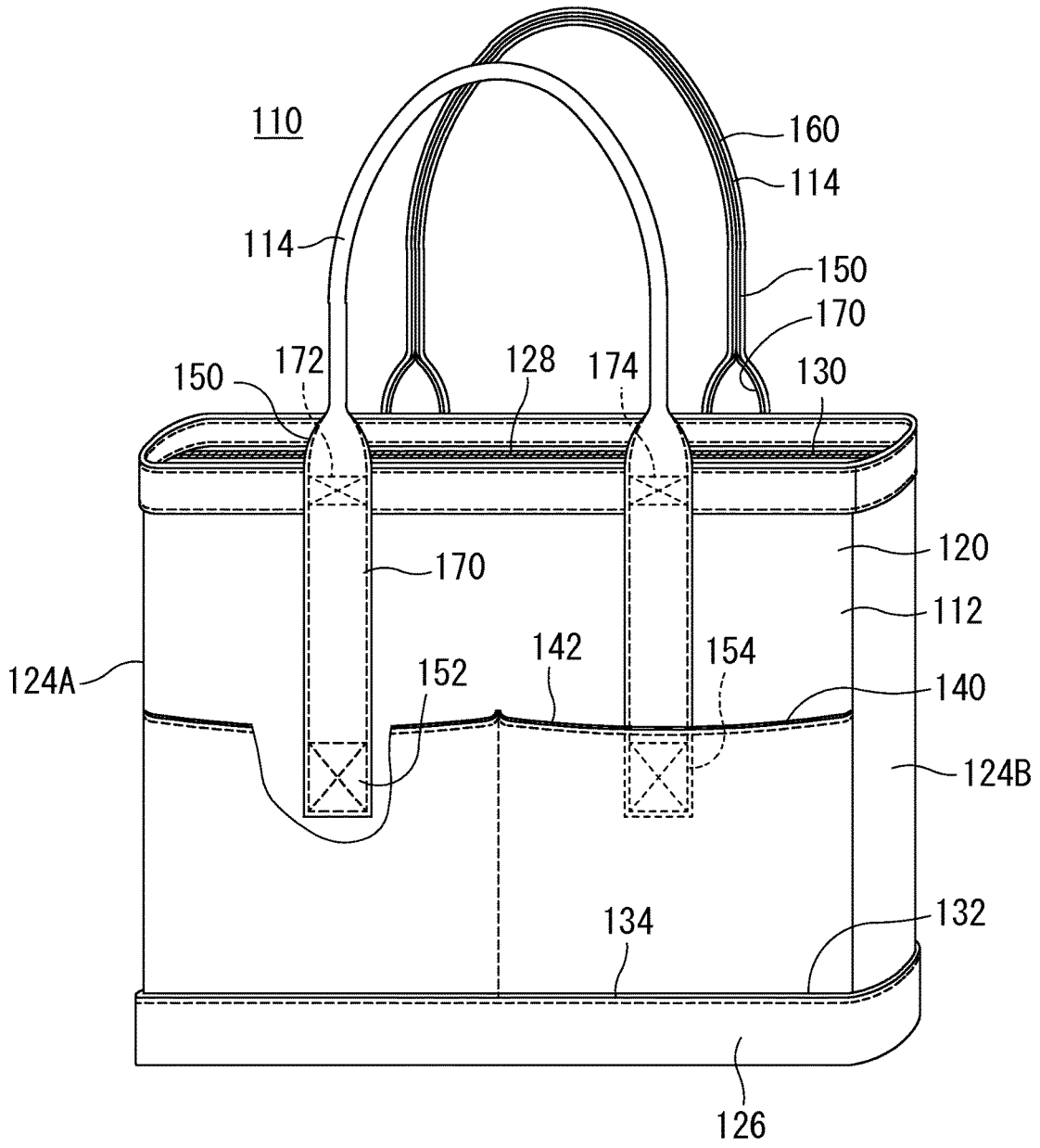
FIG. 14 is a front view of a bag using the structure of the hand-carrying portion of the bag according to another embodiment of the present invention.
Figure 15:
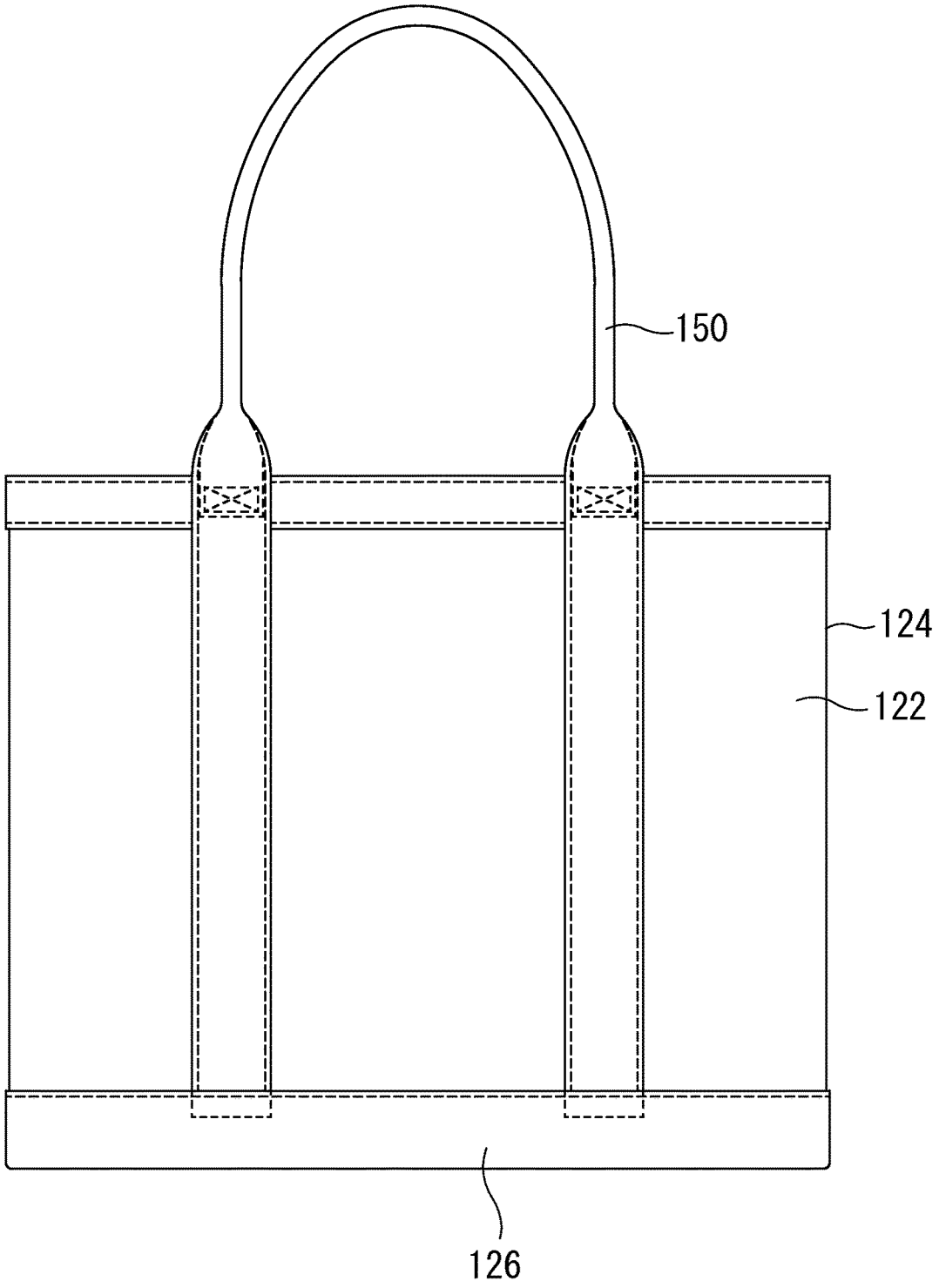
FIG. 15 is a rear view of a bag using the structure of the hand-carrying portion of the bag according to another embodiment of the present invention.
Figure 16:
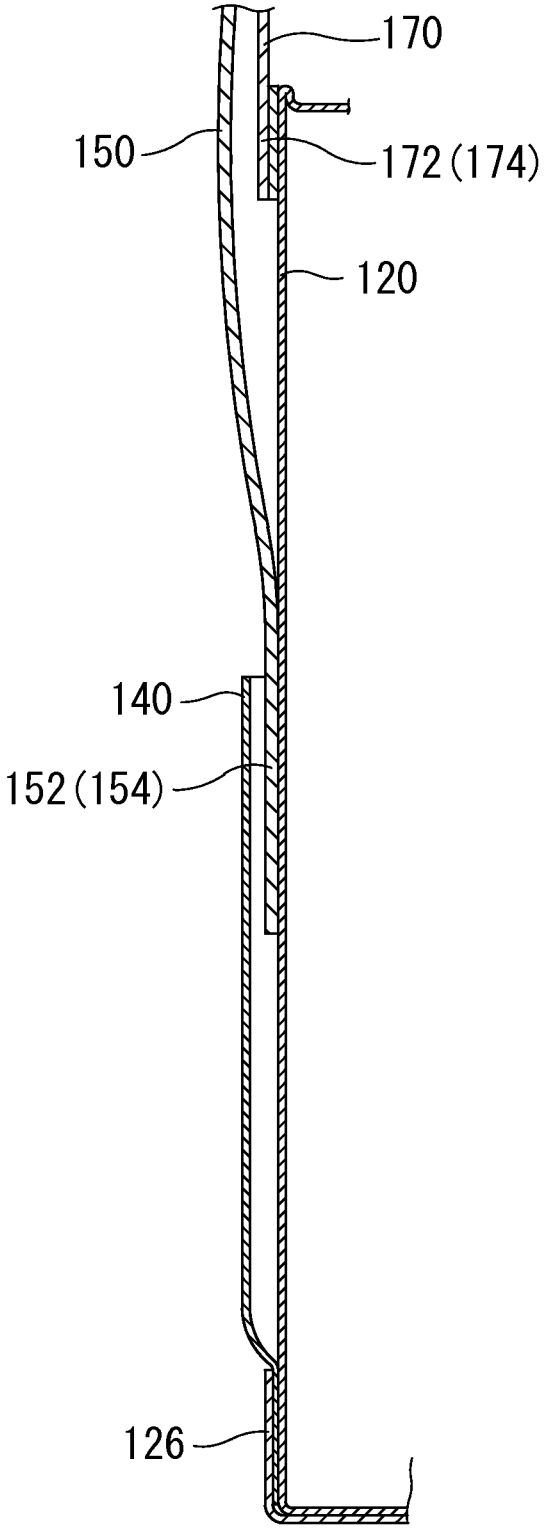
FIG. 16 is a partially enlarged cross-sectional view showing the vicinity of the hand-carrying portion of the bag of FIG. 7 in an enlarged manner.
Figure 17:
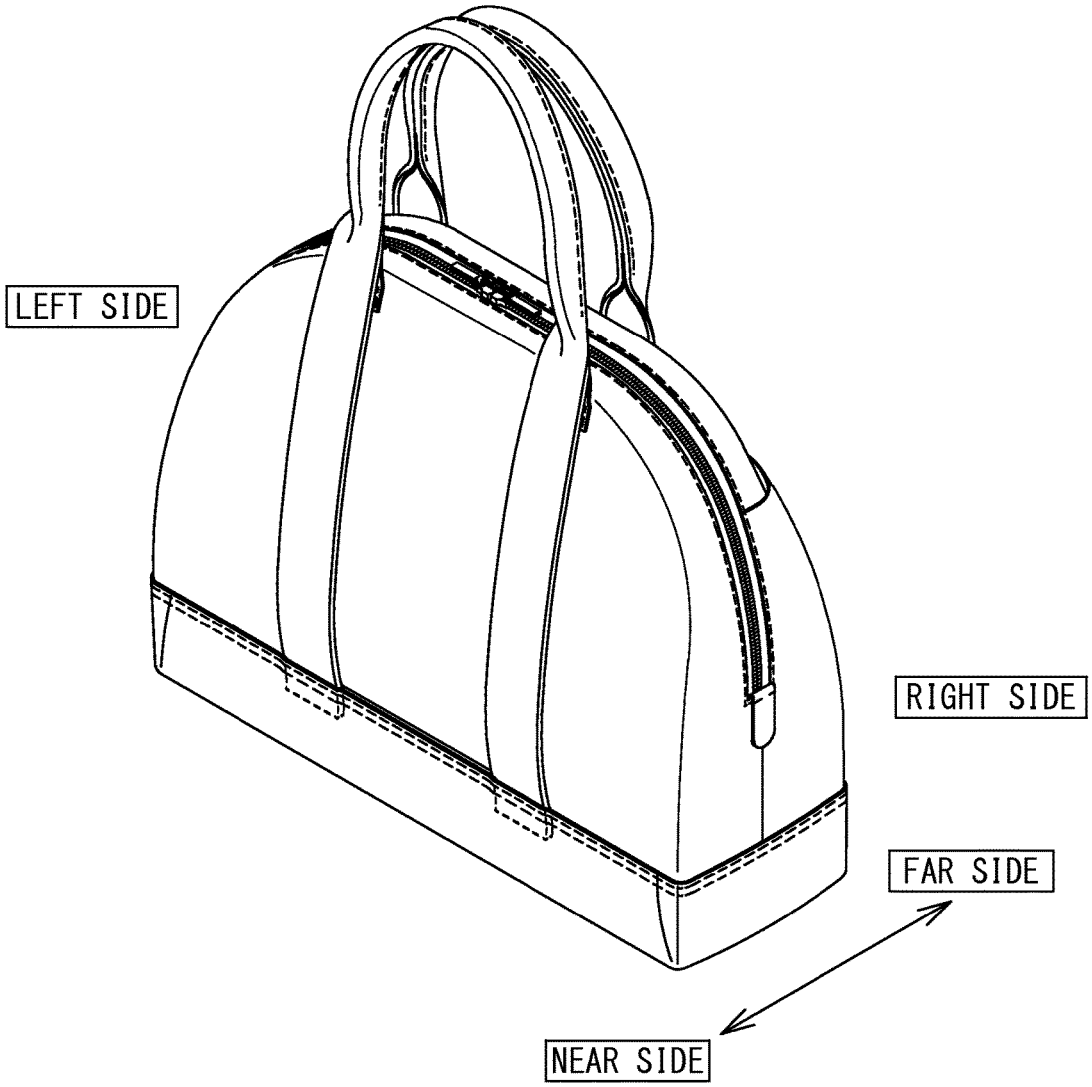
FIG. 17 is an explanatory view of the bag according to the present invention.
Figure 18:
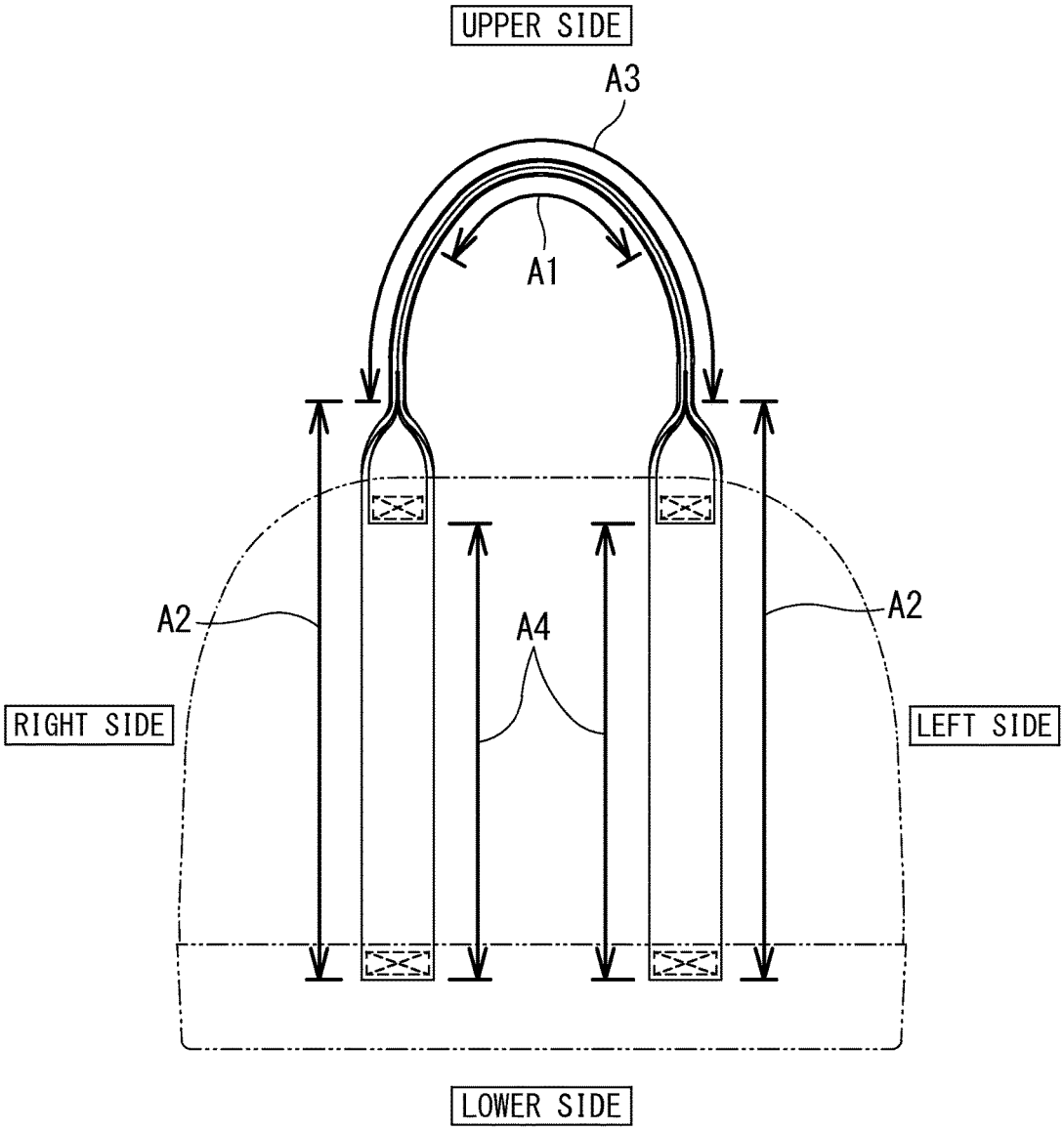
FIG. 18 is an explanatory view of the bag according to the present invention.

The structure of the hand-carrying portion of the bag according to another embodiment of the present invention will now be described based mainly on FIGS. 14 to 16.

A bag main body 112 includes a front body portion 120, a back body portion 122 facing the front body portion 120, a gore portion 124 interposed between the front body portion 120 and the back body portion 122, and a bottom portion 126 arranged at the lower ends of the front body portion 120, the back body portion 122, and the gore portion 124.

An opening 128 between the front body portion 120 and the back body portion 122 is configured to be opened and closed with a zipper 130 provided at the open edge of the front body portion 120 and an open edge of the back body portion 122.

The gore portion 124 includes a left side gore portion 124A formed on the left side of the front body portion 120, and a right side gore portion 124B formed on the right side of the front body portion 120.

The bottom portion 126 is formed by sewing a bottom member 132 overlapped with the outer surfaces of the front body portion 120, the back body portion 122, and the gore portion 124 at the lower end edges of the front body portion 120, the back body portion 122, and the gore portion 124.

The bottom member 132 is entirely formed to a plate shape, where the peripheral edge thereof is sewed to the front body portion 120, the back body portion 122, and the gore portion 124 in a bottom member joining region 134 having a constant width.

The structure of the hand-carrying portion attached to the bag main body 112 of the present invention is applied to the hand-carrying portion 114 in which the hand-carrying region A1, which is to be carried by the person's hand, is attached to extend toward the upper side of the front body portion 120 and/or the back body portion 122 on the outer side of the bag main body 112.

In the hand-carrying bag 110 that also functions as a shoulder bag according to one embodiment of the present invention, the bag main body 112 has a pocket provided on the outer side, and an extended region of an outer side hand-carrying member 150 is inserted into a pocket 140 from an article inserting opening 142 of the pocket 140 and attached to the outer surface of the bag main body 112.

The hand-carrying portion 114 includes the outer side hand-carrying member 150, and an inner hand-carrying member 170 partially overlapped with the inner side of the outer side hand-carrying member 150 in the hand-carrying region A1.

The outer side hand-carrying member 150 and the inner side hand-carrying member 170 are curved to a substantially U-shape in front view in the hand-carrying region A1.

The inner side hand-carrying member 170 is a long band-shaped body, and the outer side hand-carrying member 150 is a long band-shaped body having a wider width than the inner side hand-carrying member 170.

The outer side hand-carrying member 150 and the inner side hand-carrying member 170 are made of leather or fabric.

The outer side hand-carrying member 150 and the inner side hand-carrying member 170 have different lengths, where the outer side hand-carrying member 150 is longer than the inner side hand-carrying member 170.

The inner side hand-carrying member 170 is joined with the outer surface covered by the outer side hand-carrying member 150 in the hand-carrying region A1.

The outer side hand-carrying member 150 and the inner side hand-carrying member 170 are overlapped with an even interval between one end of the inner side hand-carrying member 170 and one end of the outer side hand-carrying member 150 and an even interval between the other end of the inner side hand-carrying member 170 and the other end of the outer side hand-carrying member 150, and are sewn together in the hand-carrying region A1.

The outer side hand-carrying member 150 and the inner side hand-carrying member 170 are overlapped with an even interval between one end of the inner side hand-carrying member 170 and one end of the outer side hand-carrying member 150 and an even interval between the other end of the inner side hand-carrying member 170 and the other end of the outer side hand-carrying member 150, where a joining region A3 of the inner side hand-carrying member 170 and the outer side hand-carrying member 150 is adhered with an adhesive.

The outer side hand-carrying member 150 and the inner side hand-carrying member 170 are curved near the middle in the width direction in the overlapped region.

The outer side hand-carrying member 150 and the inner side hand-carrying member 170 have the vicinity of the longitudinal end edge of the outer side hand-carrying member 150 and the vicinity of the longitudinal end edge of the inner side hand-carrying member 170 sewn together to form a sewing portion 160 in the overlapped region.

The sewing portion 160 is formed up to the vicinity of one end and the vicinity of the other end of the inner side hand-carrying member 170 with a spacing between regions (attachment portion 172 and attachment portion 174, to be described later) where the inner side hand-carrying member 170 is attached to the surface of the bag main body 112 in the region extended from the hand-carrying region A1.

The inner side hand-carrying member 170 has one end and the other end attached to the outer surface of the bag main body 112.

In the present embodiment, the inner side hand-carrying member 170 has one end sewn to the vicinity of the left side gore portion 124A configuring the gore portion 124 in the vicinity of the opening 128 of the front body portion 120 to form the attachment portion 172, and the other end sewn to the vicinity of the right side gore portion 124B configuring the gore portion 124 in the vicinity of the opening 128 of the front body portion 120 to form the attachment portion 174.

The inner side hand-carrying member 170 has a region configuring the attachment portion 172 and the attachment portion 174 sewn to the back surface side in a flat state of the long band-shaped body configuring the inner side hand-carrying member 170 brought into contact with the outer surface of the bag main body 112.

The inner side hand-carrying member 170 has a non-sewing region A2, which is not to be sewn to the outer side hand-carrying member 150, between the joining region A3 with respect to the outer side hand-carrying member 150 in the hand-carrying region A1, and the attachment portion 172 and the attachment portion 174.

The inner side hand-carrying member 170 has the non-joining region A4, which is not sewn to the outer side hand-carrying member 150, in a mode of a band-shaped body in a flat state of the long band-shaped body configuring the inner side hand-carrying member 170.

The outer side hand-carrying member 150 is joined to the outer side of the inner side hand-carrying member 170 in the hand-carrying region A1, and curved to a U-shape in front view with the inner side hand-carrying member 170.

The outer side hand-carrying member 150 and the inner side hand-carrying member 170 are curved to a U-shape in front view near the middle in the longitudinal direction of the long band-shaped body configuring the outer side hand-carrying member 150 and the long band-shaped body configuring the inner side hand-carrying member 170.

The outer side hand-carrying member 150 is attached on the outer side of the bag main body 112 with an appropriate interval between the attachment portion 172 of one end serving as an attachment portion to the bag main body 112 of the inner side hand-carrying member 170 and the attachment portion 174 of the other end serving as the attachment portion to the bag main body 112 in the extended region extended in the bottom direction of the bag main body 112 from the hand-carrying region A1 overlapped with the inner side hand-carrying member 170.

The outer side hand-carrying member 150 has a non-sewing region A2 that is not sewn to the inner side hand-carrying member 170 up to the position of joining with the attachment portion 172 and the attachment portion 174 of the inner side hand-carrying member 170 in the extended region extended from the joining region A3 where the outer side hand-carrying member 150 is joined to the inner side hand-carrying member 170 configuring the hand-carrying region A1.

The outer side hand-carrying member 150 has a part of the non-sewing region A2 (portion on one end side and other end side on lower side of sewing portion 160) that is not sewn to the inner side hand-carrying member 170 in a mode of a band-shaped body in a flat state of the long band-shaped body configuring the outer side hand-carrying member 150.

In the embodiment, the outer side hand-carrying member 150 has one end sewn to the front body portion 120 on the inner side of the article inserting opening 142 of the joining region of a pocket piece configuring the pocket 140 and the front body portion 120 in the vicinity of the left side gore portion 124A.

Specifically, the attachment is made at the attachment portion 152 where one end of the outer side hand-carrying member 150 sandwiched between the front body portion 120 and the pocket piece forming the pocket 140 is sewn.

Furthermore, the extended region of the outer side hand-carrying member 150 has the other end sewn to the front body portion 120 on the inner side of the article inserting opening 142 of the joining region of the pocket piece configuring the pocket 140 and the front body portion 120 in the vicinity of the right side gore portion 124B.

Specifically, the attachment is made at the attachment portion 154 where the other end of the outer side hand-carrying member 150 sandwiched between the front body portion 120 and the pocket piece forming the pocket 140 is sewn.

In the outer side hand-carrying member 150, the region configuring the attachment portion 152 at one end and the attachment portion 154 at the other end is sewn to the back surface side in a flat state of the long band shaped body configuring the outer side hand-carrying member 150 brought into contact with the outer surface of the bag main body 112.

In the extended region (non-sewing region A2) of the outer side hand-carrying member 150 extended from the hand-carrying region A1 configured by the joining region A3 (formed with sewing portion 160) where the outer side hand-carrying member 150 and the inner side hand-carrying member 170 are sewn, the outer side hand-carrying member 150 has the non-joining region A4 that is not sewn to the inner side hand-carrying member 170 in the extended region from the joining region A3 of the attachment portion 172 and the attachment portion 174 of the inner side hand-carrying member 170.

The outer side hand-carrying member 150 has the non-joining region A4 that is not joined to the inner side hand-carrying member 170 in the extended region of the outer side hand-carrying member 150 extended from the sewn joining region A3.

The outer side hand-carrying member 150 has the non-joining region A4 that is not sewn to the inner side hand-carrying member 170 in a mode of a band shaped body in a flat state of the long band shaped body configuring the outer side hand-carrying member 150.

The method for attaching the hand-carrying portion of the bag will now be described.

The method for attaching the hand-carrying portion of the bag includes a hand-carrying member adhering step of joining the inner side hand-carrying member 170 and the outer side hand-carrying member 150 with an equal interval between the one end of the inner side hand-carrying member 170 and the one end of the outer side hand-carrying member 150 and with an equal interval between the other end of the inner side hand-carrying member 170 and the other end of the outer side hand-carrying member 150, and adhering the joining region of the inner side hand-carrying member 170 and the outer side hand-carrying member 150 with an adhesive; a curving step of curving the vicinity of the middle in the width direction in a region where the outer side hand-carrying member 150 and the inner side hand-carrying member 170 are joined; a sewing step of sewing the vicinity of the longitudinal end edge of the outer side hand-carrying member 150 and the vicinity of the longitudinal end edge of the inner side hand-carrying member 170 in a region where the outer side hand-carrying member 150 and the inner side hand-carrying member 170 are joined; an inner side hand-carrying member attaching step of attaching the one end of the inner side hand-carrying member 170 and the other end of the inner side hand-carrying member 170 to the outer surface of the bag main body 112; and an outer side hand-carrying member attaching step of attaching the attachment portion 152 at one end and the attachment portion 154 at the other end on the outer side of the bag main body 112 with an appropriate interval between the attachment portions (attachment portion 172 at one end and attachment portion 174 at other end) to the bag main body 112 of the inner side hand-carrying member 170 in the extended region extended in the bottom direction of the bag main body 112 from the region where the outer side hand-carrying member 150 is joined to the inner side hand-carrying member 170.

The extended region of the outer side hand-carrying member 150 has one end and the other end attached to the outer surface of the bag main body 112 at the position of entering the pocket 140 from the article inserting opening 142 of the pocket 140, and has the pocket 140 provided on the outer side of the bag main body 112 so as to cover the attachment portion 152 and the attachment portion 154 in the extended region of the outer side hand-carrying member 150.

In the hand-carrying member adhering step, the front surface of the inner side hand-carrying member 170 and the back surface of the outer side hand-carrying member 150 are joined with an equal interval between the one end of the inner side hand-carrying member 170 and the one end of the outer side hand-carrying member 150 and with an equal interval between the other end of the inner side hand-carrying member 170 and the other end of the outer side hand-carrying member 150. The joining region of the inner side hand-carrying member 170 and the outer side hand-carrying member 150 is adhered with the adhesive applied in advance to the front surface of the inner side hand-carrying member 170 and the back surface of the outer side hand-carrying member 150.

In the curving step, the outer side hand-carrying member 150 and the inner side hand-carrying member 170 both have the vicinity of the middle in the width direction of a region configuring the hand-carrying region A1 curved to a substantially C-shape in the region where the outer side hand-carrying member 150 and the inner side hand-carrying member 170 are joined.

In the sewing step, the vicinity of the longitudinal end edge of the outer side hand-carrying member 150 and the vicinity of the longitudinal end edge of the inner side hand-carrying member 170 are sewn in the region where the outer side hand-carrying member 150 and the inner side hand-carrying member 170 are joined by the curving step.

The longitudinal end edge of the outer side hand-carrying member 150 and the longitudinal end edge of the inner side hand-carrying member 170 that are curved are aligned, the opposing back surfaces of the inner side hand-carrying member 170 are brought into contact, and the outer side hand-carrying member 150 and the inner side hand-carrying member 170 are sewn.

In the inner side hand-carrying member attaching step, one end of the inner side hand-carrying member 170 and the other end of the inner side hand-carrying member 170 are attached to the outer surface of the bag main body 112.

The one end and the other end of the inner side hand-carrying member 170 are attached to the bag main body 112 with an appropriate space suited for carrying by hand.

In the outer side hand-carrying member attaching step, the outer side hand-carrying member 150 has the attachment portion 152 at one end and the attachment portion 154 at the other end attached on the outer side of the bag main body 112 with an appropriate interval between the attachment portions (attachment portion 172 at one end and attachment portion 174 at other end) to the bag main body 112 of the inner side hand-carrying member 170 in the extended region extended in the bottom direction of the bag main body 112 from the region where the outer side hand-carrying member 150 is joined to the inner side hand-carrying member 170.

In order to form the pocket 140, the pocket configuring material such as leather, fabric, and the like configuring the pocket 140 are attached to the bag main body 112 after attaching the outer side hand-carrying member 150 to the bag main body 112 at the attachment portion 152 at one end and the attachment portion 154 at the other end, thus forming the pocket 140.

The bag having a structure of the hand-carrying portion 114 of the bag according to the present invention is thereby formed.

The configuring modes of the embodiments described above do not limit the present invention, and changes can be made based on the concept of the invention, which changes are to be encompassed in the invention.

DESCRIPTION OF SYMBOLS

10 hand-carrying bag
12, 112 bag main body
14, 114 hand-carrying portion

20, 120 front body portion
22, 122 back body portion
24, 124 gore portion
24A, 124A left side gore portion
24B, 124B right side gore portion
26, 126 bottom portion
28, 128 opening
30, 130 zipper
32, 132 bottom member
34, 134 bottom member joining region
50, 150 outer side hand-carrying member
70, 170 inner side hand-carrying member
52, 54, 72, 74, 152, 154, 172, 174 attachment portion
56 sandwiching portion
60, 160 sewing portion
110 hand-carrying bag
140 pocket
142 article inserting opening
A1 hand-carrying region
A2 non-sewing region
A3 joining region
A4 non-joining region

The invention claimed is:

1. A structure of a hand-carrying portion attached to a bag main body, comprising:

an outer side hand-carrying member; and an inner side hand-carrying member partially overlapped with an inner side of the outer side hand-carrying member, wherein the inner side hand-carrying member is a long, band-shaped body, and the outer side hand-carrying member is a long, band-shaped body having a wider width than the inner side hand-carrying member, the outer side hand-carrying member and the inner side hand-carrying member have different lengths, the outer side hand-carrying member being longer than the inner side hand-carrying member, the inner side hand-carrying member is joined with the outer side hand-carrying member on an outer surface covered by the outer side hand-carrying member in a joining region including a hand-carrying region, the inner side hand-carrying member has a non-joining region, which is not sewn to the outer side hand-carrying member, the non-joining region being a flat, band-shaped portion of the long, band-shaped body that makes up the inner side hand-carrying member, the outer side hand-carrying member is joined to an outer side of the inner side hand-carrying member in the joining region including the hand-carrying region, and the outer side hand-carrying member is curved to a U-shape with the inner side hand-carrying member in the hand-carrying region in a front view, the outer side hand-carrying member is folded around the inner side hand-carrying member to form an overlapped region centered between one end of the inner side hand-carrying member and another end of the inner side hand-carrying member, and centered between one end of the outer side hand-carrying member and another end of the outer side hand-carrying member, the outer side hand-carrying member and the inner side hand-carrying member are sewn together in a vicinity of a longitudinal end edge of the outer side hand-carrying member and a vicinity of a longitudinal end edge of the inner side hand-carrying member to form a sewing portion in the overlapped region so as to form the joining region including the hand-carrying region, the one end of the inner side hand-carrying member is attached to the outer surface of the main bag body at one attachment portion, and the another end of the inner side hand-carrying member is attached to the outer surface of the main bag body at another attachment portion, the sewing portion extends to a vicinity of the one end of the inner side hand-carrying member and a vicinity of the another end of the inner side hand-carrying member, such that a space exists between the sewing portion and the one attachment portion, and a space exists between the sewing portion and the another attachment portion, the outer side hand-carrying member includes a flat-shaped extended region that extends in a top-to-bottom direction of the bag main body from the joining region including the hand-carrying region overlapped with the inner side hand-carrying member, in the extended region of the outer side hand-carrying member, the outer side hand-carrying member has a non-joining region where the outer side hand-carrying member is not sewn to the inner side hand-carrying member, the non-joining region includes a sandwiching portion for sandwiching an article in a space between the inner side of the outer side hand-carrying member and the outer surface of the bag main body, the outer side hand-carrying member is attached, at one end, to the outer side of the bag main body at a first lower attachment portion in the extended region of the outer side hand-carrying member, and, at another end, to the outer side of the bag main body at a second lower attachment portion, the first and second lower attachment portions spaced apart from each other, such that an interval exists between the one attachment portion of the inner side hand-carrying member and the first lower attachment portion of the outer side hand-carrying member and between the another attachment portion of the inner side hand-carrying member and the second lower attachment portion, and the lower attachment portion includes a flat portion of the outer side hand-carrying member brought into contact with, and sewn to, the outer surface of the bag main body.

2. The structure of the hand-carrying portion of the bag according to claim 1, wherein the bag main body has a bottom member attached to an outer side of the bag main body, and the extended region of the outer side hand-carrying member is inserted between the bottom member and the bag main body from an edge portion of a bottom member joining region to the bag main body of the bottom member, and attached to the outer surface of the bag main body and/or the inner surface of the bottom member.

3. The structure of the hand-carrying portion of the bag according to claim 1, further comprising:

a pocket attached to the outer side of the main bag body, wherein the extended region of the outer side hand-carrying member is inserted into the pocket from an article inserting opening of the pocket, and is attached to the outer surface of the bag main body in a region of the outer surface of the bag main body covered by the pocket.

4. The structure of the hand-carrying portion of the bag according to claim 1, wherein the extended region of the outer side hand-carrying member has a sandwiching portion for sandwiching an article between the inner side of the outer side hand-carrying member and the outer surface of the bag main body.

5. The structure of the hand-carrying portion of the bag according to claim 1, wherein the bag main body has a bottom member attached to an outer side of the bag main body, and the extended region of the outer side hand-carrying member is inserted between the bottom member and the bag main body from an edge portion of a bottom member joining region to the bag main body of the bottom member, and attached to the outer surface of the bag main body and/or the inner surface of the bottom member.

6. The structure of the hand-carrying portion of the bag according to claim 1, further comprising:

a pocket attached to an outer side of the main bag body, wherein the extended region of the outer side hand-carrying member is inserted into the pocket from an article inserting opening of the pocket, and is attached to the outer surface of the bag main body in a region of the outer surface of the bag main body covered by the pocket.

7. A method for attaching a hand-carrying portion of a bag, the method comprising the steps of:

joining an inner side hand-carrying member and an outer side hand-carrying member such that an interval between one end of the inner side hand-carrying member and one end of the outer side hand-carrying member is equal to an interval between another end of the inner side hand-carrying member and another end of the outer side hand-carrying member, the inner side hand-carrying member being a long, band-shaped body, and the outer side hand-carrying member being a long, band-shaped body having a wider width than the inner side hand-carrying member, the outer side hand-carrying member and the inner side hand-carrying member having different lengths, such that the outer side hand-carrying member is longer than the inner side hand-carrying member;

curving the inner side hand-carrying member and the outer side hand-carrying member, which is joined to the outer side of the inner side hand-carrying member, to a U-shape in front view in a joining region including the hand-carrying region, the inner side hand-carrying member and the outer side hand-carrying member being curved in a width direction of the inner side hand-carrying member and the outer side hand-carrying member, the inner side hand-carrying member having a non-joining region, which is not sewn or joined to the outer side hand-carrying member, the non-joining region being a flat portion of the long, band-shaped body that forms the inner side hand-carrying member;

sewing a vicinity of a longitudinal end edge of the outer side hand-carrying member and a vicinity of a longitudinal end edge of the inner side hand-carrying member together in the joining region where the outer side hand-carrying member and the inner side hand-carrying member are joined to form a sewing portion, such that the outer side hand-carrying member is folded around the inner side hand-carrying member to form an overlapped region centered between the one end of the inner side hand-carrying member and the another end of the inner side hand-carrying member, and centered between the one end of the outer side hand-carrying member and the another end of the outer side hand-carrying member, and the sewing portion is formed in the overlapped region;

attaching back surfaces of the one end of the inner side hand-carrying member and the other end of the inner side hand-carrying member to an outer surface of the bag main body to form one attachment portion at the one end of the inner side hand-carrying member and another attachment portion at the another end of the inner side hand-carrying member, such that the one end and the other end of the inner side hand-carrying member rest flat against the outer surface of the bag main body, and the sewing portion extends to a vicinity of the one end of the inner side hand-carrying member and a vicinity of the another end of the inner side hand-carrying member, such that a space exists between the sewing portion and the one attachment portion, and a space exists between the sewing portion and the another attachment portion; and attaching back surfaces of the one end and the other end of the outer side hand-carrying member to the outer side of the bag main body to form one lower attachment portion and another lower attachment portion, such that the one end and the other end of the outer side hand-carrying member rest flat against the outer surface of the of the bag main body, wherein attaching the back surfaces of the one end and the other end of the outer side hand-carrying member to the outer side of the bag main body includes forming a sandwiching portion for sandwiching an article in a space between an inner side of the outer side hand-carrying member and the outer surface of the bag main body in the non-joining region, such that the non-joining region of the outer side hand-carrying member is formed in the extended region of the outer side hand-carrying member, or in a non-sewing region extended from the hand-carrying region, and the one lower attachment portion and the another lower attachment portion each include a flat portion of the outer side hand-carrying member brought into contact with, and sewn to, the outer surface of the bag main body.

* * * * *